United States Patent [19]

Meier

[11] 4,444,142

[45] Apr. 24, 1984

[54] SEWING MACHINE CONTROL ASSEMBLY FOR ADJUSTING STITCH LENGTH

[75] Inventor: Willi Meier, Karlsruhe-Durlach, Fed. Rep. of Germany

[73] Assignee: Dorina Nahmaschinen GmbH, Fed. Rep. of Germany

[21] Appl. No.: 380,957

[22] Filed: May 21, 1982

[30] Foreign Application Priority Data

May 29, 1981 [DE] Fed. Rep. of Germany ..... 3121266

[51] Int. Cl.[3] ..... D05B 27/22

[52] U.S. Cl. ..... 112/315; 74/831

[58] Field of Search ..... 112/314, 315, 316, 323; 74/828, 831; 428/408, 90, 325, 375, 387, 404, 429

[56] References Cited

U.S. PATENT DOCUMENTS

| | | | |
|---|---|---|---|
| 1,124,524 | 1/1915 | Reeves | 74/831 |
| 2,970,556 | 2/1961 | Johnson | 112/315 |
| 3,250,556 | 5/1966 | Couch et al. | 428/90 X |
| 3,464,882 | 9/1969 | Morton | 428/375 |
| 4,029,829 | 5/1977 | Weaver et al. | 428/408 X |
| 4,042,747 | 8/1977 | Breton et al. | 428/325 X |
| 4,183,314 | 1/1980 | Sato | 112/316 |
| 4,242,251 | 12/1980 | Aishima et al. | 428/404 X |

*Primary Examiner*—Werner H. Schroeder
*Assistant Examiner*—Andrew M. Falik
*Attorney, Agent, or Firm*—McGlew and Tuttle

[57] ABSTRACT

A control assembly for varying the transmission ratio between a sewing machine driving shaft eccentric for feed dog transverse movement, and thus the feed and stitch widths, of a sewing machine which includes an oscillating lever mounted for oscillation adjacent to the feed dog and connected to it to move it backwardly and forwardly and an eccentric drive acting on the feed dog to move it upwardly and downwardly. The control assembly includes a push rod having one end connected to the oscillating lever to oscillate it and an opposite end having a pin thereon which is confined for movement in an oblong slot of a link which is articulated at its opposite end to one arm of a double armed lever, the other arm of which is engaged by the driving shaft eccentric to oscillate it. The pin carries a sliding block which is engaged in a sliding block guide and they are both made of a plastic having a sliding surface at their engagement surfaces. The guide is displaced in order to vary the oscillation of the feed dog in transverse directions.

14 Claims, 3 Drawing Figures

SEWING MACHINE CONTROL ASSEMBLY FOR ADJUSTING STITCH LENGTH

FIELD AND BACKGROUND OF THE INVENTION

This invention relates in general to sewing machines, and in particular to a new and useful sliding block control assembly therefor.

The prior art sliding block control assembly known from German Pat. 1,027,970 is made of steel. In modern sewing machines in which the control mechanisms are set through stepping motors, the control assemblies are made of aluminum, to reduce the masses to be moved. All such control assemblies have the disadvantage that the mutually parallel guide surfaces of the sliding block and the respective guide must be machined with great precision to reduce the play in the guidance to a minimum. This requirement entails considerable manufacturing costs. To obtain a precise and noiseless operation of the feed or stitch width regulating device, a very small play is absolutely necessary.

SUMMARY OF THE INVENTION

The invention is directed to a sliding block control assembly which has a very small weight and is inexpensive in manufacture.

Due to the inventive construction, the control assembly not only has a very small mass, but its slide surfaces engage substantially without play and are self-adjusting, so that the assembly does not produce any noise during the operation of the sewing machine.

In accordance with the invention a control assembly for varying the transmission ratio between a sewing machine driving shaft eccentric for feed dog transverse movement and thus the feed and stitch width in a sewing machine is provided which includes an oscillating lever mounted for oscillation adjacent the feed dog and connected to it to move it backwardly and forwardly and an eccentric drive acting on the feed dog to move it upwardly and downwardly as it is moved transversely. The mechanism includes a push rod having one end connected to the oscillating lever to oscillate it and an opposite end which carries a pin having a sliding block thereon which is engageable in a sliding block guide. The pin engages in a slide of a link member which is carried on an oscillating double arm lever which engages the driving shaft eccentric and the pin is urged into an end position in an associated slot of the link. The sliding block and the sliding block guide are made of a plastic having good sliding characteristics.

Accordingly, it is an object of the invention to provide an improved control assembly for varying the transmission ratio between a sewing machine driving shaft eccentric for driving a feed dog transversely and thus for varying the feed and stitch width.

A further object of the invention is to provide a sewing machine drive which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
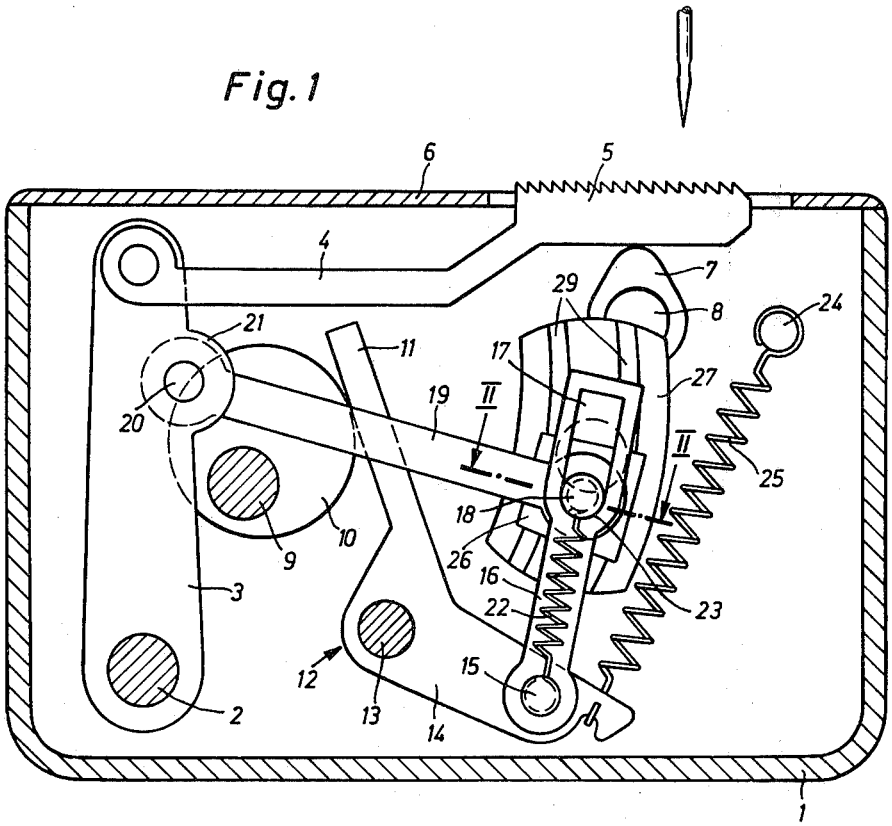
FIG. 1 is a sectional view of a lower part of a sewing machine indicating a sliding block control assembly in the material feed drive constructed in accordance with the invention.
Figure 2:
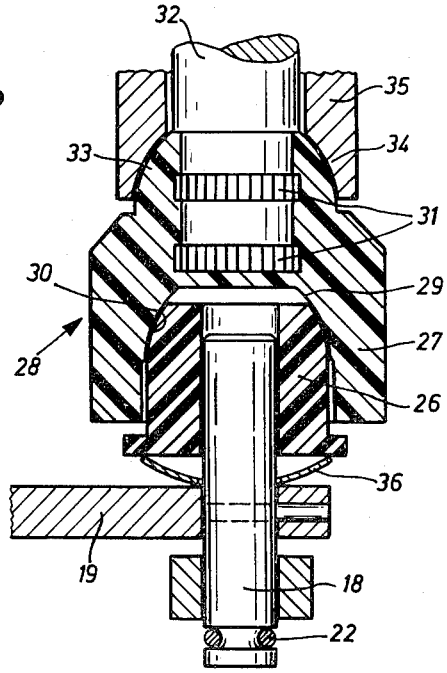
FIG. 2 is a sectional view taken along the line II—II of FIG. 1.

Referring to the drawings, in particular the invention embodied therein in FIGS. 1 and 2, comprises a control assembly for varying the transmission ratio between a sewing machine driving shaft 9 and its associated eccentric 10 for a feed dog 5 in transverse directions and thus for varying the feed and stitch widths. The apparatus is contained in a sewing machine having an oscillating lever 3 mounted for oscillation adjacent to the feed dog and connected to the feed dog through a support 4 for moving it backwardly and forwardly. A lift drive or eccentric drive includes a shaft 8 having an eccentric 7 which acts on feed dog 5 and moves it upwardly and downwardly during its transverse movement.

In accordance with the invention the control mechanism includes a push rod 19 having one end connected to the oscillating lever 3 to oscillate it and having an opposite end which contains a pin 18 forming a base for a sliding block 26 and which is confined in a slot 17 of a link member 16. The link member 16 has an opposite end connected by a pin 15 to an arm 14 of a double armed lever 12. Double armed lever 12 is mounted for oscillation on a shaft 13 and has another arm 11 which is engaged on eccentric 10 of drive shaft 9. The sliding block 26 is carried on the pin 18 and the sliding block guide 27 is located adjacent the pin and has an adjustable portion engaged on the sliding block 26. The sliding block guide 27 is displaceable to vary the position of the pin 18 during the oscillation of the lever 12 and hence varying the transmission ratio.

In a lower arm 1 (FIG. 1) of the housing of a sewing machine, a shaft 2 is mounted to which oscillating lever 3 is secured. Connected to lever 3 is support 4 for feed dog 5 which is secured to the free end of support 4 and protrudes through a cover plate 6 of the lower arm 1. From below, feed dog 5 is contacted by lifting eccentric 7 which is secured to shaft 8 which in turn is mounted in lower arm 1 of the sewing machine and connected to the drive thereof.

The shaft 9 is also mounted in lower arm 1, to which eccentric 10 is secured. Shaft 9 is connected to the drive of the sewing machine (not shown). The double lever 12 is secured to shaft 13 mounted in lower arm 1, and one arm 11 of lever 12 applies against eccentric 10. The other arm 14 of double lever 12 is connected through pin 15 to link 16 in which oblong slot 17 is provided for pin 18. Pin 18 is secured to one end of a push rod 19 which is pivoted at its other end, by means of a bolt 20, to an eye 21 of oscillating lever 3. Pin 18 is urged against a stop 23 of oblong slot 17 by means of a spring 22 which is attached to both pin 15 and pin 18. Pin 18, stop 23, and spring 22 form an elastic coupling.

Another spring 25 which is attached to arm 14 of double lever 12 and to a stud 24 provided in lower arm 1, pulls arm 11 against eccentric 10. The non-positive engagement between eccentric 10 and arm 11 is a second elastic coupling within the oscillatory drive of pin 18.

The sliding block 26 is mounted for rotary motion on pin 18 and cooperates with sliding block guide 27. Sliding block 26 and guide 27 form the control assembly 28. Guide 27 comprises an arcuate slideway including an arcuate bottom and adjacent oblique slide surfaces 29 cooperating with conformable slide surfaces 30 of sliding block 26. Guide 27 is injection-molded onto proper end portions 31 of a setting shaft 32 and has a spherical protrusion 33 by which it is in turn guided in a correspondingly shaped socket 34 of a support 35 which is fixed to the housing. Setting shaft 32 which is rotatable in support 35 is connected to a control lever to be actuated by the operator.

Guide 27 and sliding block 27 are made of plastic. The use of plastic for the component parts of control assembly 28 results in favorable glide and friction characteristics. Experience has shown, that plastics containing PTFE (polytetrafluoroethylene) and silicone or graphite powder as additives are particularly suitable for this purpose.

Slide surfaces 30 of sliding block 26 are pressed against slide faces 29 of guide 27 by means of a cup spring 36 which is provided on pin 18 between sliding block 26 and push rod 19. Slide surfaces 29 and 30 extend obliquely to the direction in which spring 36 exerts its force.

The shape and orientation of slide surfaces 29 and 30 make allowance for compensation between guide 27 and sliding block 26, for moisture pickup, thermal expansion, or wear.

During operation of the sewing machine, shaft 9 rotates to that eccentric 10, through double lever 12 and link 16, moves sliding block 26 on slide surfaces 29 of guide 27 back and forth. In accordance with the angular position of guide 27, which is predetermined by a position of shaft 32 set by an actuating lever (not shown), sliding block 26 imparts through push rod 19 a pivotal motion to oscillatory lever 3 and thus moves feed dog 5 in a reciprocating motion whose extent and direction depend on the angular position of guide 27.

Lifting eccentric 7 is driven by shaft 8 in synchronism with the rotation of shaft 9 and imparts lifting motion to feed dog 5.

While being moved, the feed dog may become blocked by needles or other objects. With eccentric 10 then causing a pivotal motion of double lever 12 and link 16, slot 17 allows link 16 to move relative to stop pin 18 and to sliding block 26 which is connected thereto. Only spring 22 is thereby tensioned. Upon unblocking feed dog 5, spring 22 brings pin 18 again into contact with stop 23 of slot 17.

If feed dog 5 becomes blocked during its back motion, eccentric 10 disengages from arm 11 of double lever 12, so that damage to control assembly 28 is avoided. Upon unblocking, spring 25 returns arm 11 into contact with eccentric 10.

Figure 3:
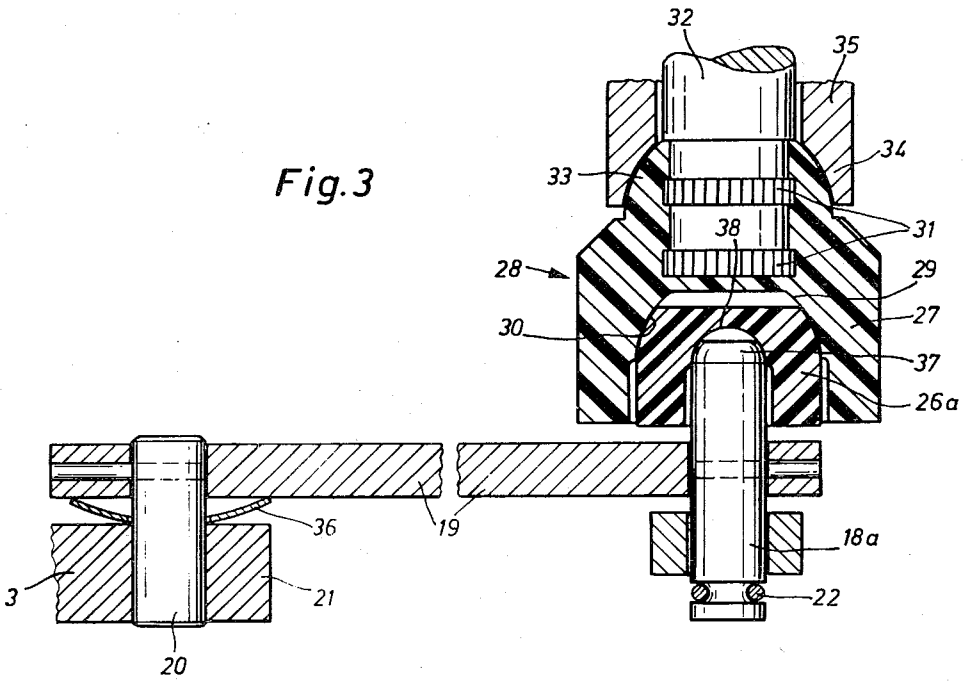
FIG. 3 is a view similar to FIG. 2 of another embodiment of the invention.

The embodiment shown in FIG. 3 is substantially identical with that of FIGS. 1 and 2. Like reference numerals are used for identical parts. Only the design of the sliding block and its carrying pin, and the arrangement of the cup spring are different.

Pin **18*a* of the embodiment of FIG. 3 is designed with a spherical zone 37 on its end projecting into sliding block 26*a*, which zone engages a socket 38 formed in the block 26*a***.

Further, in this embodiment, a cup spring **36*a* is provided between eye 21 of oscillating lever 3 and push rod 19, on bolt 20 which is axially displaceable in eye 21. The pressure exerted by cup spring 36*a* on push rod 19 results in an engagement between pin 18*a*, socket 38, sliding block 26*a*, and guide 27, which is absolutely free from play. Due to the material selection combined with a specific shape, a backlash-free, easy-motion mounting of control assembly 28** requiring no maintanence is obtained.

While specific embodiments of the invention have been shown and described in detail to illustrate the application of the principles of the invention, it will be understood that the invention may be embodied otherwise without departing from such principles.

What is claimed is:

1. A sliding block control assembly for varying the transmission ratio of the feed and/or stitch width adjusting mechanism of a sewing machine, comprising an adjustable guide means connected to setting means for setting the guide means in a given stationary angular position of adjustment for varying such transmission ratio, and a sliding block mounted for oscillating sliding displacement in the guide means in any position of adjustment thereof and operatively connected to an oscillating drive for the feed and/or stitch width mechanism and which drive is adapted to be coupled to the sewing drive of the sewing machine for synchronous operation therewith, the guide means and sliding block having opposed mating pairs of sliding surfaces which extend obliquely to a plane of motion of said sliding block, and spring means for self-adjustably biasing said mating pairs of sliding surfaces toward each other in mutual sliding non-positive engagement with each other in any position of adjustment of the guide means during oscillating displacement of the sliding block relative thereto, the sliding surfaces of at least one of the guide means and the sliding block being composed of a plastic material having good sliding characteristics.

2. Assembly according to claim 1 wherein the sliding surfaces of both the guide means and the sliding block are composed of said plastic material.

3. Assembly according to claim 1 wherein the guide means includes a sliding block guide having a spherical protrusion and the setting means include a setting shaft fixidly attached to the guide, and a support is provided which receives the setting shaft and which has a corresponding spherical support socket in which the spherical protrusion of the guide is operatively mounted for adjustment of the stationary angular position of the guide therein via the setting shaft to change the position of the sliding surfaces of the guide and in turn of the corresponding oscillating path of sliding displacement of the sliding block for varying such transmission ratio.

4. Assembly according to claim 1 wherein the oscillating drive includes a transmission linkage containing a driven rod carrying a pin and the sliding block is mounted for rotation on the pin, and said spring means includes a cup-shaped spring operatively interposed between the rod and the sliding block for urging the sliding surfaces of the block against the sliding surfaces of the guide means.

5. Assembly according to claim 1 wherein the oscillating drive includes a transmission linkage containing a driven rod carrying a pin having an end portion provided with a spherical surface, and the sliding block is mounted for rotation on the pin and contains a corresponding spherical block socket in engagement with the spherical surface of the pin.

6. Assembly according to claim 1 wherein the plastic material is polytetrafluoroethylene having a silicone added thereto.

7. Assembly according to claim 1 wherein the plastic material includes graphite powder added thereto.

8. Assembly according to claim 1 wherein the oscillating drive includes a transmission linkage containing a driven rod on which the sliding block is operatively mounted, and said spring means comprises a resilient driving coupling operatively connected to the driven rod for providing a resilient connection thereat in both the forward and return directions of the oscillating drive and in turn a resilient self-adjusting control of the oscillating sliding displacement of the sliding block in the guide means.

9. A control assembly for varying the transmission ratio between a sewing machine driving shaft eccentric for feed dog transverse movement and thus for the feed and stitch width, in a sewing machine including an oscillating lever mounted for oscillation adjacent to and connected to said feed dog to move said feed dog backwardly and forwardly, and an eccentric drive acting on said feed dog to move it upwardly and downwardly as it is moved transversely, the improvement comprising a push rod having one end connected to said oscillating lever to oscillate it and an opposte end, an oscillating double armed lever having a first arm engaged with said driving shaft eccentric for oscillatable movement thereby and a second arm, a link articulated to said second arm and having an oblong slot spaced from its connection to said second arm, a pin connected to said opposite end of the push rod and controlling the movement in said slot, a sliding block carried on said pin, a sliding block guide mounted in a fixed position adjacent said pin and having an adjustable portion engagable on said sliding block and being displaceable to vary the position of said pin during oscillation of said oscillating lever, said sliding block and said sliding block guide being made of a plastic material having good sliding surfaces.

10. Assembly according to claim 9, wherein said guide includes a spherical protrusion, and a socket member mounting said guide at said protrusion and having a setting shaft pivotally mounted therein and carrying said guide.

11. Assembly according to claim 9, wherein said block is mounted on said pin for rotation, and a cup spring disposed between said block and said push rod and urging said block in the direction towards said guide.

12. Assembly according to claim 9, wherein said pin includes an end surface engaged in said block and having a spherical surface, said block having a socket portion having a spherical surface in engagement with the spherical surface of said pin.

13. Assembly according to claim 9, wherein said block is made of polytetrafluoroethylene having a silicone added thereto.

14. Assembly according to claim 9 including a graphite powder in said plastic of said block.

* * * * *